US006739021B2

(12) United States Patent
Rabello

(10) Patent No.: US 6,739,021 B2
(45) Date of Patent: May 25, 2004

(54) THERAPEUTIC MAGNETIC HAND WRAP OR GRIP

(75) Inventor: Billy Pak Rabello, San Pedro, CA (US)

(73) Assignee: Billy Rabello, San Pedro, CA (US)

( * ) Notice: Subject to any disclaimer, the term of this patent is extended or adjusted under 35 U.S.C. 154(b) by 712 days.

(21) Appl. No.: 09/757,855

(22) Filed: Jan. 10, 2001

(65) Prior Publication Data

US 2003/0163896 A1 Sep. 4, 2003

(51) Int. Cl.[7] ..... A45C 13/22

(52) U.S. Cl. ..... 16/430; 16/431; 16/DIG. 12; 16/421; 473/302

(58) Field of Search ..... 16/430, 431, 421, 16/DIG. 12; 473/549, 551, 568, 300–303, 521, 523; 15/154, 162, 171, 172; 428/167, 168, 137, 138, 172; 74/551.9; 600/9, 15; 601/120; 81/451, 125, 452

(56) References Cited

U.S. PATENT DOCUMENTS

| | | | | | |
|---|---|---|---|---|---|
| 3,950,838 | A | * | 4/1976 | Oseroff et al. | 29/407.01 |
| 4,044,625 | A | * | 8/1977 | D'Haem et al. | 74/558.5 |
| 4,053,676 | A | * | 10/1977 | Kaminstein | 428/313.5 |
| 5,364,677 | A | * | 11/1994 | Sendziak | 428/40.1 |
| 5,492,425 | A | * | 2/1996 | Carter et al. | 401/10 |
| 5,575,760 | A | * | 11/1996 | Masuda | 601/19 |
| 5,795,242 | A | * | 8/1998 | Ree | 473/303 |
| 5,813,971 | A | * | 9/1998 | Broderick | 600/15 |
| 5,997,421 | A | * | 12/1999 | Huang | 473/549 |
| 6,217,504 | B1 | * | 4/2001 | Phillips | 600/9 |
| 6,236,306 | B1 | * | 5/2001 | Liebelt | 340/407.1 |
| RE37,702 | E | * | 5/2002 | Huang | 473/302 |
| 6,398,712 | B1 | * | 6/2002 | Hendricksen | 600/9 |

FOREIGN PATENT DOCUMENTS

| | | | | | |
|---|---|---|---|---|---|
| DE | 2510173 | A | * | 9/1976 | A61H/15/00 |
| DE | 2639038 | A | * | 3/1978 | A61H/15/00 |
| JP | 08187329 | A | * | 7/1996 | A63F/07/02 |

* cited by examiner

*Primary Examiner*—Chuck Y. Mah
(74) *Attorney, Agent, or Firm*—Marcia Devon

(57) ABSTRACT

A magnet to provide magnetic flux therapeutic pain-easing and healing effects built into a resilient grip or wrap for the handle of a hand held device. The therapeutic magnetic hand grip or wrap can be used on the handles of golf clubs, tennis racquets, baseball bats, bicycle handlebars, vehicle steering wheels, crutches, cane, and into bandages.

17 Claims, 1 Drawing Sheet

THERAPEUTIC MAGNETIC HAND WRAP OR GRIP

BACKGROUND OF THE INVENTION

A. Field of the Invention

This invention relates to combining a resilient wrap or grip for the handle of a hand-held device and a magnet to provide therapeutic pain easing and healing effects to the operator of such a device. Some applications of this invention include the handles of golf clubs, tennis racquets, baseball bats, bicycle handlebars, vehicle steering wheels, crutches, walking stick, cane, and into bandages.

B. Description of the Prior Art

Magnetic therapy is believed to promote healing and the reduction of pain and provides a natural, drug-free method of managing pain. Magnetic field therapy is known to stimulate the circulation of blood, accelerate the oxygenation of blood cells, reduce fluid retention and inflammation and thus increase the body's natural healing ability. Magnetic field therapy is believed to promote healing, to increase tissue temperature, and to reduce pain in those areas of the body where magnetic flux therapy is applied. Magnetic flux therapy has also been used to treat arthritis.

The force or impact shock generated by the impact between a baseball and a baseball bat or a golf club and a golf ball can adversely affect muscle tissue in the hand and wrist, particularly if the activity is performed repeatedly. The energy generated by such impact is known as "impact shock". The use of magnetic flux therapy can reduce the effects of the "impact shock" transmitted through a grip for the handle of a hand-held device and into the user of the device.

The prior art does not disclose an apparatus for providing therapy to an operator of a hand-held device while it is being used and over a long period of time. The prior art only addresses the problem of reducing the amount of shock transmitted through the grip to the user.

U.S. Pat. No. 5,715,539 entitled "Gloves and Implements Containing a Flexible Magnetic Strip to Improve Grip" describes "ways to improve one's grip on an implement through the use of thin, flexible magnetic strips. The flexible magnetic strips can be worn with the glove or by the user gripping the implement which has the magnetic strip." Alternatively, the flexible magnetic strips can be used with either the glove or the implement, with the opposing glove or implement surface coated or imbedded with a magnet attracting material. The user's grip is improved due to the magnetic interaction between the glove and the implement. U.S. Pat. No. 5,715,539 discloses a device which uses magnets in a manner suited for improving the operator's grip via a special glove and handle arrangement not a magnetic flux real-time therapy device built into a resilient grip as in the present invention.

U.S. Pat. No. 6,026,717 entitled "Driver Tool with High Energy Magnetizer/Demagnetizer on Tool Handle" discloses a hand-held driving tool which "includes an elongated handle which defines a tool axis and is suitably shaped and dimensioned to be graspable within the hand of the user. The driving tool maybe in the form of a fixed, precision or other drivers in which the driver members, such as flat blade and Phillips screwdriver tips are mounted at axial of the handle. The handle defines a driver axis generally coaxially aligned with the tool axis. At least one permanent magnet is provided on the handle, the magnet being formed of a magnetized material having north and south poles defining a magnetic axis generally arranged on the handle to permit selective placement of a magnetizable element at least one position along the magnetic axis at a predetermined distance from one of the poles to magnetize the element and placement of the element a distance greater than such predetermined distance of the other of the poles to demagnetize the element. The magnetic axis is either aligned with or offset from the driver axis. In this way, a magnetizable element may be magnetized by positioning same adjacent to one of the poles and demagnetized by positioning the magnetizable element adjacent the other of the poles. The magnets used have an energy product equal to at least 7.0.times. 10.sup.6 gauss-oersteds. Although the magnets may be embedded within the handle, the magnets may be oriented in relation to the surfaces of the handle or a hole within the handle to facilitate placement of the part to be magnetized very closely to the magnetizing pole and somewhat more distantly positioned in relation to the demagnetizing pole." U.S. Pat. No. 6,026,717 describes a handle for a type of screwdriver incorporating a magnet to attach, magnetize, and demagnetize removable driver bits. The magnet is not intended to provide magnetic flux therapy. The present invention includes a magnetic strip to create a magnetic flux therapy device built into a resilient grip. The device operator is afforded the convenience, anonymity, and real-time therapy that only the Therapeutic Magnetic Hand Grip can provide.

SUMMARY OF THE INVENTION

The invention includes the combination of a magnetic flux therapy device embedded in a resilient grip for the handle of a hand-held device, for example: sporting equipment, including rackets and bats, tools, and the steering wheel of a vehicle.

The resilient grip is comprised of four mutually-attached layers. A resilient outer layer with an inner surface, a first edge, a second edge, and an outer surface provides a tacky surface, which inhibits slippage of a user's hand relative to the resilient grip. A pliable magnetic layer with an inner surface, a first edge, a second edge, and an outer surface bonded to the inner surface of the resilient outer layer. The next strip is a felt layer with an inner surface, a first edge, a second edge, and an outer surface bonded to the inner surface of the pliable magnetic layer. The inner most layer is a pliable double sided tape layer with an inner surface, a first edge, a second edge, and an outer surface bonded to the inner surface of the felt layer. The four mutually-attached layers form a magnetic strip with a tape adhesive inner surface.

The strip is spirally wrapped and adhered about the handle of a hand held device with the first edge of the resilient outer layer overlapping itself enough on each successive handle turn to allow the first edge of the pliable magnetic layer to butt up against each successive turn layer first edge forming a continuous magnetic layer within the resilient grip. The pliable magnetic layer is fabricated in a manner, which prevents corrosion.

The strip may be spirally wrapped around the handle of a golf club, tennis racquet, racquetball racket, hockey stick, baseball bat, bicycle handlebar, hammer, shovel, an axe, walking stick, cane, as a bandage, a pair of crutches, or any other hand held device. The strip may also be spirally wrapped about a sleeve thereby creating a slip-on resilient grip, which is then attached directly to the handle of a hand held device.

The resilient outer layer can be made from one of the following rubber, vinyl, leather, or plastic. The resilient grip of the present invention can be easily installed by a user, will provide a long service life, and may be manufactured at a relatively low cost.

These and other features and advantages of the present invention will become apparent from the following detailed description, when taken in conjunction with the appended drawings.

DETAILED DESCRIPTION OF PREFERRED EMBODIMENTS

Figure 1:
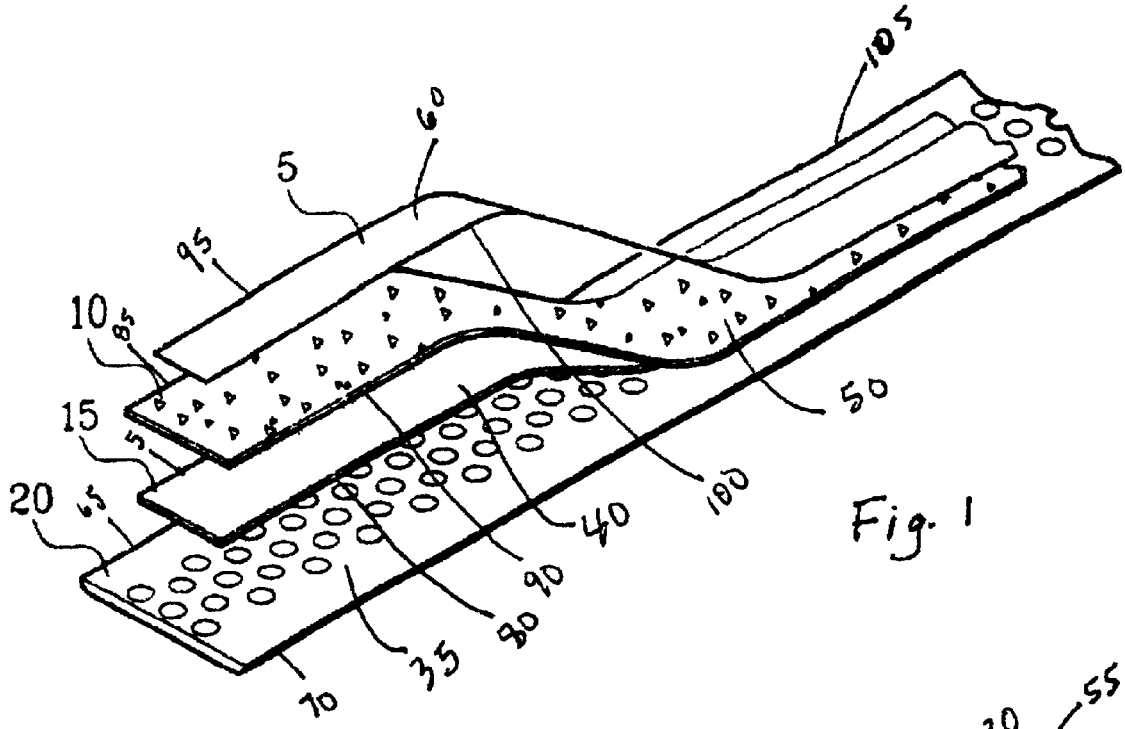
FIG. 1 is an inverted exploded view of the four-ply tapes with the inner most layer on top.
Figure 2:
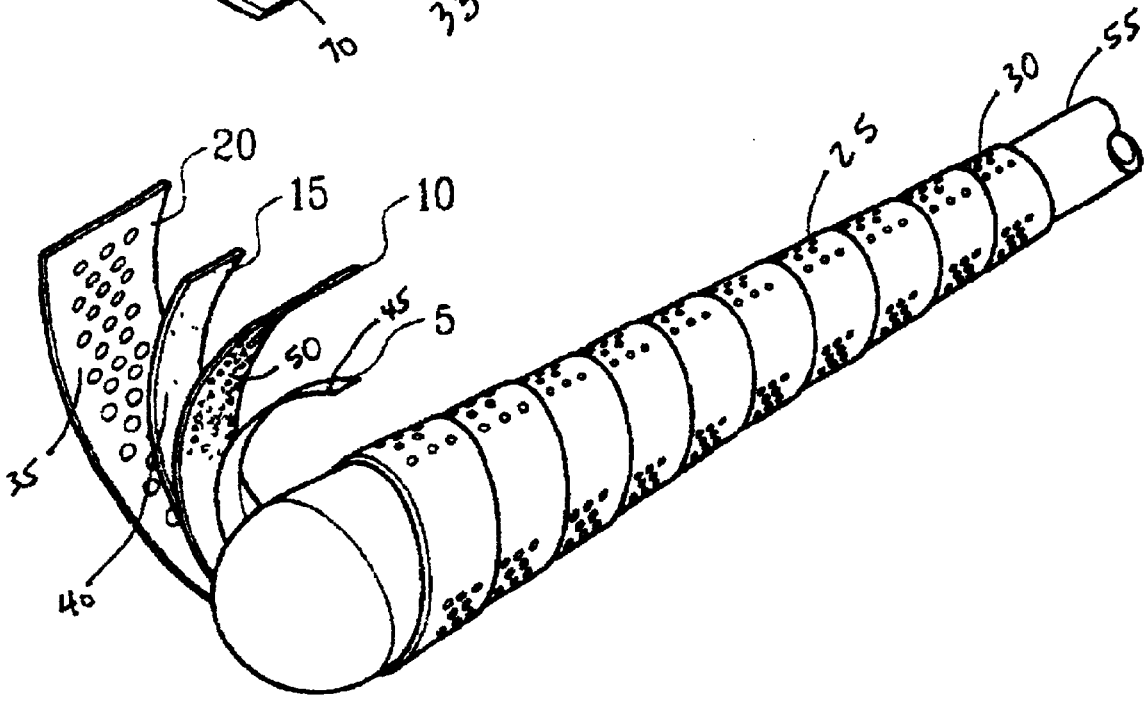
FIG. 2 is an orthogonal view of the strip being directly spirally wrapped about a tapered handle.

The invention includes the combination of a magnetic flux therapy device mounted into a resilient grip 25 for the handle of a hand held device as shown in FIGS. 1 and 2. The resilient grip 25 s made up of four mutually attached layers. A resilient outer layer 20 with an inner surface 35, a first edge 70, a second edge 65, and an outer surface 30 provides a tacky surface 30 which inhibits slippage of a user's hand relative to the resilient grip 25. A pliable magnetic layer 15 with an inner surface 40, a first edge 80, a second edge 75, and an outer surface bonded to the inner surface 35 of the resilient outer layer 20. Next comes a strip consisting of a felt layer 10 with an inner surface 50, a first edge 90, a second edge 85, and an outer surface bonded to the inner surface 40 of the pliable magnetic layer 15. The inner most layer is a pliable double sided tape layer 5 with an inner surface 60, a first edge 100, a second edge 95, and an outer surface 45 bonded to the inner surface 50 of the felt layer 10. The four mutually attached layers form a magnetic strip 105 with a tape adhesive inner surface 60.

The strip 25 is spirally wrapped and adhered about the handle 55 of a hand held device with the first edge 70 of the resilient outer layer 20 overlapping itself enough on each successive handle turn to allow the first edge 80 of the pliable magnetic layer 20 to butt up against each successive turn layer first edge 80 forming a continuous magnetic layer within the resilient grip 25. The pliable magnetic layer 20 is fabricated in a manner to prevent corrosion.

The strip 105 may be directly spirally wrapped about the handle of a golf club, tennis racquet, racquetball racket, hockey stick, baseball bat, bicycle handlebar, hammer, shovel, an axe, walking stick, cane, into a bandage, a pair of crutches, or any other hand held device. The strip 105 may also be spirally wrapped about a sleeve thereby creating a slip-on resilient grip, which is then attached directly to the handle of a hand held device.

The resilient outer layer 20 can be made from one of the following rubber, vinyl, leather, or plastic. The resilient grip of the present invention can be easily installed by a user, will provide a long service life, and may be manufactured at a relatively low cost.

These and other features and advantages of the present invention will become apparent from the following detailed description, when taken in conjunction with the appended drawings.

What is claimed is:

1. The combination of a magnetic flux therapy device and a resilient wrap for a handle of a hand held device, comprising:

a resilient outer layer with an inner surface, a first edge, a second edge, and an outer surface providing a tackiness so as to inhibit slippage of a user's hand relative to a handle;

a pliable magnetic layer with an inner surface, a first edge, a second edge, and an outer surface bonded to the inner surface of said resilient outer layer;

a layer consisting of a felt layer with an inner surface, a first edge, a second edge, and an outer surface bonded to the inner surface of said pliable magnetic layer;

a pliable, double-sided tape layer with an inner surface, a first edge, a second edge, and an outer surface bonded to the inner surface of said felt layer;

the four mutually attached layers form a magnetic strip with a tape adhesive inner surface; and said strip being wrapped and adhered about the handle of a hand held device with the first edge of said resilient outer layer overlapping itself enough on each successive handle turn to allow the first edge of said pliable magnetic layer to abut against each successive turn magnetic layer first edge forming a continuous magnetic layer within a resilient grip.

2. The Therapeutic resilient wrap as defined in claim 1, wherein said strip may also be spirally wrapped about a sleeve said sleeve provides a slip-on resilient grip, which is then attached directly to the handle of a hand held device.

3. The Therapeutic resilient wrap as defined in claim 2, wherein said resilient outer layer can be made from one of the following rubber, vinyl, leather, or plastic.

4. The Therapeutic resilient wrap as defined in claim 1, wherein said wrap is installed in a vehicle steering wheel.

5. Therapeutic resilient wrap as defined in claim 1, wherein said wrap can be installed onto a golf club.

6. The Therapeutic resilient wrap as defined in claim 1, wherein said wrap can be installed onto a tennis racket.

7. The Therapeutic resilient wrap as defined in claim 1, wherein said wrap can be installed onto a hockey stick.

8. The Therapeutic resilient wrap as defined in claim 1, wherein said wrap can be installed onto a baseball bat.

9. The Therapeutic resilient wrap as defined in claim 1, wherein said wrap can be installed onto a bicycle handlebar.

10. The Therapeutic resilient wrap as defined in claim 1, wherein said wrap can be installed onto a hammer.

11. The Therapeutic resilient wrap as defined in claim 1, wherein said wrap can be installed onto a shovel.

12. The Therapeutic resilient wrap as defined in claim 1, wherein said wrap can be installed onto an axe.

13. The Therapeutic resilient wrap as defined in claim 1, wherein said wrap can be installed onto a racket.

14. The Therapeutic resilient wrap as defined in claim 1, wherein said wrap can be installed into a bandage.

15. The Therapeutic resilient wrap as defined in claim 1, wherein said wrap can be installed onto a pair of crutches.

16. The Therapeutic resilient wrap as defined in claim 1, wherein said wrap can be installed onto a walking stick.

17. The Therapeutic resilient wrap as defined in claim 1, wherein said wrap can be installed onto a cane.

* * * * *